United States Patent [19]

Mitchell et al.

[11] 4,212,634

[45] Jul. 15, 1980

[54] AUXILIARY HEATING SYSTEM FOR A BULK TOBACCO BARN

[75] Inventors: John D. Mitchell, Lewiston; J. C. Sessoms, Jr., Ahoskie, both of N.C.

[73] Assignee: Harrington Manufacturing Company, Lewiston, N.C.

[21] Appl. No.: 912,335

[22] Filed: Jun. 5, 1978

[51] Int. Cl.[2] ..... F27B 17/00; A24B 1/02

[52] U.S. Cl. ..... 432/186; 110/260; 432/190; 432/199; 432/500

[58] Field of Search ..... 432/176, 186, 188, 189, 432/190, 199, 500; 122/22; 110/260

[56] References Cited

U.S. PATENT DOCUMENTS

| | | | |
|---|---|---|---|
| 1,961,143 | 6/1934 | Gehnrich | 432/176 |
| 3,827,851 | 8/1974 | Walker | 110/260 |
| 4,011,041 | 3/1977 | Taylor | 432/176 |

*Primary Examiner*—John J. Camby
*Attorney, Agent, or Firm*—Mills & Coats

[57] ABSTRACT

The present invention entails a bulk tobacco barn having a generally enclosed drying area and a forced air heating system associated directly with the barn for generating a system of air and circulating the air through tobacco supported within the drying area of the barn. As a part of the forced air heating system, there is provided heating means that is thermostatically controlled to heat the system of air to maintain an appropriate temperature level within the drying area of the structure during the curing and drying process. Provided in conjunction with the bulk tobacco barn is an auxiliary heating system that comprises a stove or heater having a fire box for receiving and burning material such as wood or coal. In accordance with the present invention, during curing and drying, a portion of the system of air being circulated through the bulk barn can be directed to the heater or stove of the auxiliary heating system where the air passes in a close heat exchange relationship with the heater such that the air is heated, and then is directed back into the system of air being circulated through the bulk barn.

9 Claims, 4 Drawing Figures

AUXILIARY HEATING SYSTEM FOR A BULK TOBACCO BARN

The present invention relates to bulk tobacco curing and drying and more particularly to bulk tobacco barns or drying structures utilized to cure and dry tobacco.

BACKGROUND OF THE INVENTION

In recent years Americans and people all over the world have come to recognize that our conventional sources of energy are limited and that there is a real need to conserve energy as well as to commercially develop other energy sources. The field of agriculture is not without energy problems, and in fact because of the nature of agricultural products, much energy is required in harvesting, curing, drying, and processing certain agricultural products.

Tobacco farmers over the past decade have become more mechanized, and as a part of this, automatically controlled bulk tobacco barns have replaced many of the conventional stick type barns that were so prevalent before the acceptance of bulk curing and which basically transferred heat to the tobacco by natural convection. Bulk barns have been accepted for a good time, but with the acceptance of bulk barns came the energy crisis and the rising cost of fuel and electricity. In addition, certain fuels have been quite scarce and this has affected tobacco farmers with bulk tobacco barns. A very serious problem is presented once the availability of fuel that a farmer has relied upon in the past becomes questionable.

Though the tobacco farmer has been faced with high fuel costs, and sometimes the unavailability of fuel, it still seems that these problems are not often considered serious. Many producers of bulk tobacco barns have taken steps to make the barns more energy efficient, such steps including providing better insulation, more efficient fans, and educating the farmer in proper curing and drying techniques. But still the overall effort made seems relatively small compared to the problem, and there still exists a need for a real and practical energy contribution in the area of bulk tobacco barns that can be used by the tobacco farmer to cut fuel costs and to answer or help answer the problem raised by the unavailability of certain fuels.

SUMMARY OF INVENTION

The present invention relates to an auxiliary heating system that is adapted to be connected to or to form a part of a conventional bulk tobacco barn. The utilization of the auxiliary heating system of the present invention can reduce total fuel costs for curing and drying tobacco, and because the auxiliary heating system includes a stove or heater that can burn coal or wood, these particular fuel sources, i.e., wood, coal, or the like, are often available to the farmer as a fuel source at an economical cost. Often tobacco farmers will have a supply of wood on their farm that can be cut and utilized, and/or the same farmer can use coal or other material that can be burned within the heater or stove of the auxiliary heating system.

As a part of the present invention, the auxiliary heating system is intended to be used in conjunction with a conventional forced air furnace system which is primarily relied upon to heat the air sufficient to cure and dry a barn of tobacco. In the embodiment disclosed herein, the conventional forced air heating system generates and circulates a system of air through the tobacco material within a drying area of the bulk barn and is provided with conventional heating means such as a gas or oil burner that is thermostatically controlled for heating the air as necessary to maintain a given temperature level within the barn. As a part of the auxiliary heating system, there is provided means for directing a portion of the system of air being circulated through the barn to the auxiliary heating system where that same air is heated and returned back to the system of air being circulated through the bulk tobacco barn. A temperature control means is provided for cooperatively controlling the forced air heating system and the auxiliary heating system. Generally, the temperature control means is provided with means for sensing the temperature within the curing and drying structure and controlling the heater of said auxiliary heating system to maintain a certain temperature level within the curing and drying structure. At any time within the curing and drying schedule, the heat output of the auxiliary heating system is insufficient to maintain a desired temperature level within the curing and drying structure, then the temperature control means will actuate the forced air heating system of the curing and drying structure and will control the same such that a sufficient heat output is caused to occur to maintain a temperature within the curing and drying structure at a certain temperature level.

It is, therefore, an object of the present invention to provide an auxiliary heating system for a bulk tobacco barn wherein the auxiliary heating system includes a wood or coal burning stove or heater.

Still a further object of the present invention is to provide a wood type burning auxiliary heating system for a bulk tobacco barn such that a tobacco farmer may utilize wood, coal, or other material as a supplemental fuel source to cure and dry his tobacco crop.

Another object of the present invention is to provide a bulk tobacco barn with a cooperative dual heating system wherein one of the heating systems is adapted to burn wood or coal or the like.

Another object of the present invention resides in the provision of a bulk tobacco barn having a conventional forced air heating system with a gas or oil burner, and a second auxiliary heating system that is adapted to burn wood, coal or the like, and wherein temperature control means is provided and is operative to control both of said heating systems with priority heat being furnished by the auxiliary heating system and any additional heat needed to maintain a certain temperature level within the barn being provided by the conventional forced air heating system.

A further object of the present invention resides in the provision of the bulk tobacco barn having the conventional forced air heating system and the second auxiliary heating system wherein the second auxiliary heating system is provided with means for directing a portion of the system of air being circulated through the curing and drying structure by the conventional forced air heating system and directing that portion of air to said auxiliary heating system which is provided with an outer air passing wall or heat exchanger where the air passes generally uniformly between the outer wall and the heater collecting heat therefrom, from which the air is directed back to said system of air being circulated through the bulk tobacco barn.

It is also an object of the present invention to provide a bulk tobacco barn with the dual heating systems generally described above wherein the auxiliary heating system is provided with a fire box surrounded by an open air passing area that is designed such that air directed to the open area is generally uniformly dispersed about the heater or fire box in an uniform manner where heat from wood or coal being burned within the firebox is transferred to the passing air.

Finally, an object of the present invention resides in the provision of a bulk tobacco barn having a conventional forced air heating system and a second auxiliary wood burning or coal burning heater wherein the auxiliary heating system is designed so as to be effective, practical, and efficient.

Other objects and advantages of the present invention will become apparent from a study of the following description and the accompanying drawings which are merely illustrative of the present invention.

DESCRIPTION OF PREFERRED EMBODIMENT

Figure 1:
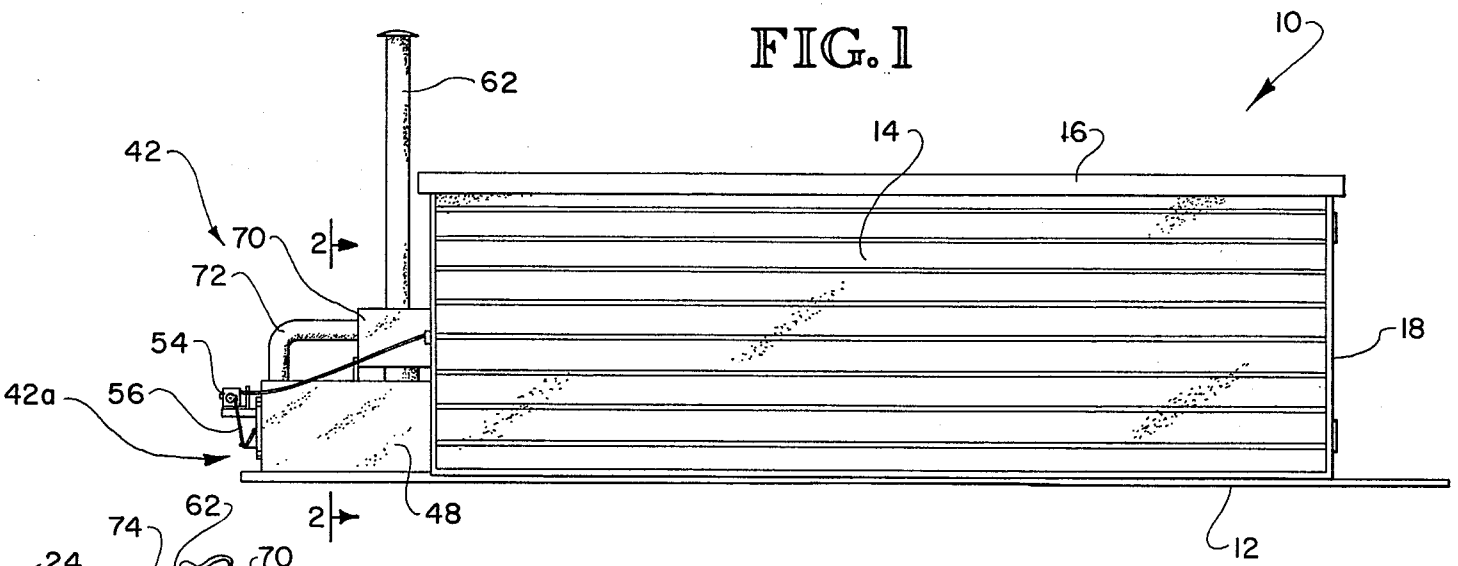
FIG. 1 is a side elevational view of the bulk tobacco barn of the present invention having the auxiliary heating system associated therewith.
Figure 2:
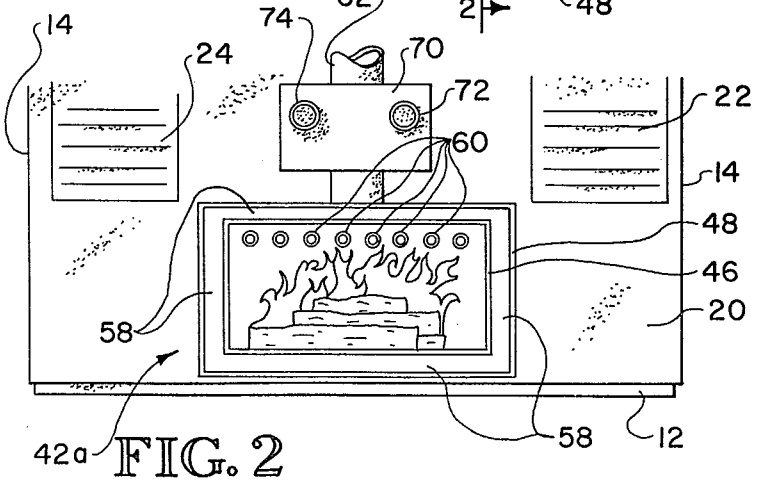
FIG. 2 is a fragmentary cross sectional view taken along the lines 2—2 in FIG. 1.

With further reference to the drawings, a bulk tobacco barn is shown therein and indicated generally by the numeral 10. Bulk tobacco barn 10 is of the type supported about a concrete slab 12 and includes a pair of sides 14, a top 16, a front 18 that is provided with one or more doors (not shown) in order to gain entrance thereto, and a back wall 20. Disposed about the back wall 20 is a pair of furnace room doors 22 and 24 that provide excess to a furnace room, indicated generally by numeral 26, that is provided about a back rear portion of the barn 10.

Formed forwardly of the furnace room 26 is a generally open area that is referred to as a curing and drying room or chamber 28 or as a curing and drying area.

As with conventional bulk tobacco barns, bulk barn 10 is provided with support means 34 that is adapted to support a plurality of conventional bulk tobacco containers 32 above a plenum area 30 defined below the lower level of the bulk tobacco containers 32.

Within the furnace room 26, there is provided a conventional forced air heating system indicated generally by the numeral 35, that is adapted to generate a system of air and to circulate that system of air downwardly into the lower plenum area 30 of the barn, up through the tobacco contained within the bulk tobacco containers 32 and back through the forced air heating system. Conventional forced air heating system 35 includes a fan 38 that is electrically driven by a motor 40. Disposed below fan 38 is a gas ring burner 36 that is supplied with gas during selected curing and drying periods such that a flame is provided about the room burner. It is, therefore, appreciated that air when directed downwardly pass the fan is moved pass the burner 36 such that when the same is burning with a flame, the heat from the flame is transferred to the air. It is appreciated that the conventional forced air heating system 35 could include other types of burners, such as a conventional oil burner.

Disposed adjacent the furnace room 26 is an auxiliary heating system, indicated generally by the numeral 42, which is adapted to operate in conjunction with the conventional forced air heating system 35 to heat the system of air being circulated through the drying area or drying chamber 28 of barn 10.

Viewing the auxiliary heating system 10 in detail, it is seen that the same includes a heater or stove **42*a* including a fire box 44 with a hinged door 45 that includes a latch arm 47 for securing the door to the back wall of heater 42*a*. Surrounding fire box 44 is an inner wall 46. Disposed exteriorly of the inner wall about the top, the bottom, and both sides is an outer wall 48 and because the outer wall is spaced from the inner wall 46, an open area 58 is defined about substantially the entire heater or fire box area 44. The purpose of this open area will become more apparent from subsequent portions of this disclosure, but it can be stated that its utility is that of a heat exchanger since air will be moved through the open area 58 defined between the walls 46 and 48**, to collect heat therefrom during the curing and drying operation.

Figure 3:
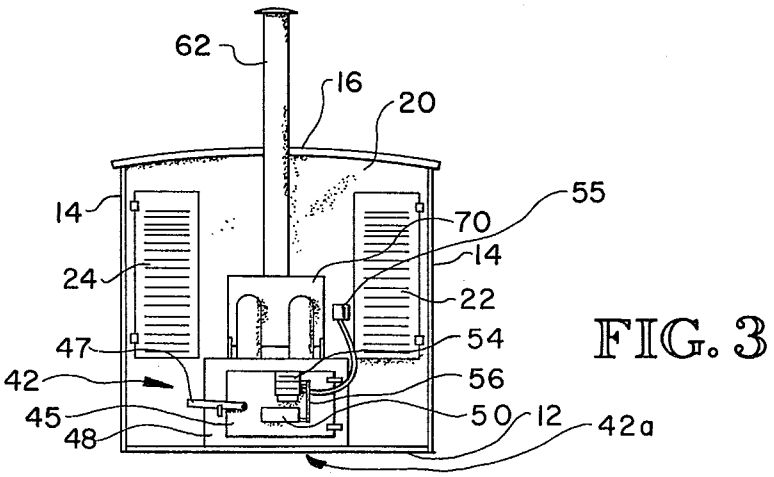
FIG. 3 is a rear elevational view of the bulk tobacco barn of the present invention.

A draft opening 52 is provided about door 45 and this opening is opened and closed by a damper 50 pivotably mounted adjacent the opening and movable from a closed position to an opened position. A mechanical damper controller, indicated by the numeral 54, is mounted adjacent the damper and appropriately connected thereto by a linkage control 56. Controller 54 is controlled by a control unit 55, that as illustrated in FIG. 3, can be mounted on the rear end 20 of the barn and which is conventionally provided with a temperature probe that is appropriately positioned within the drying area of the barn and adapted to sense temperature. Details of the control unit 55 and controller 54 are not dealt with herein in detail because such control devices are well known in the art and conventionally utilized to control such variables as wet bulb temperature in other drying systems, including bulk tobacco curing and drying. It should be pointed out that control unit 55 and damper controller 54 form a part of a temperature control system for the entire bulk tobacco barn 10, that allows for a desired temperature to be set, and for the various controls to provide that temperature within the barn 10. Generally with respect to the auxiliary heating system 42, it will be appreciated that when the actual temperature within the barn is below that being called for, then the control unit 55 and the damper control 54 will act to open the draft opening 52 such that more air can be pulled within the fire box 44, which would increase the combustion therein and which would in turn increase the heat output thereof. Once the temperature within the barn 10 reaches the set temperature or goes above the set temperature, then the damper 50 closes to reduce the air being drafted through the fire box 44 and consequently the heat output of the heater **42*a* of the auxiliary heating system 42. In the end, the temperature is maintained at or approximately a set or scheduled temperature by the modulating effect of the damper 50 with respect to the draft opening 52**.

Continuing to refer to the auxiliary heating system 42 and the heater thereof, a plurality of spaced apart pipes, indicated by the numeral 60, extend exposed through the fire box generally horizontally. Pipes 60 include an inlet end that is communicatively connected to the open area between the double wall construction 46 and 48 of the heater. Pipes 60 also include an exiting end that extends through the back of the fire box 44 and is communicatively connected to the plenum area 30 disposed about the lower portion of the bulk barn 10.

Communicatively connected to the fire box 44 is a flue 62 that extends upwardly therefrom. Therefore, it is appreciated that as air is drafted through draft opening 52, that the combustion gases combine with the air and move up the flue 62 where they are exhausted.

Figure 4:
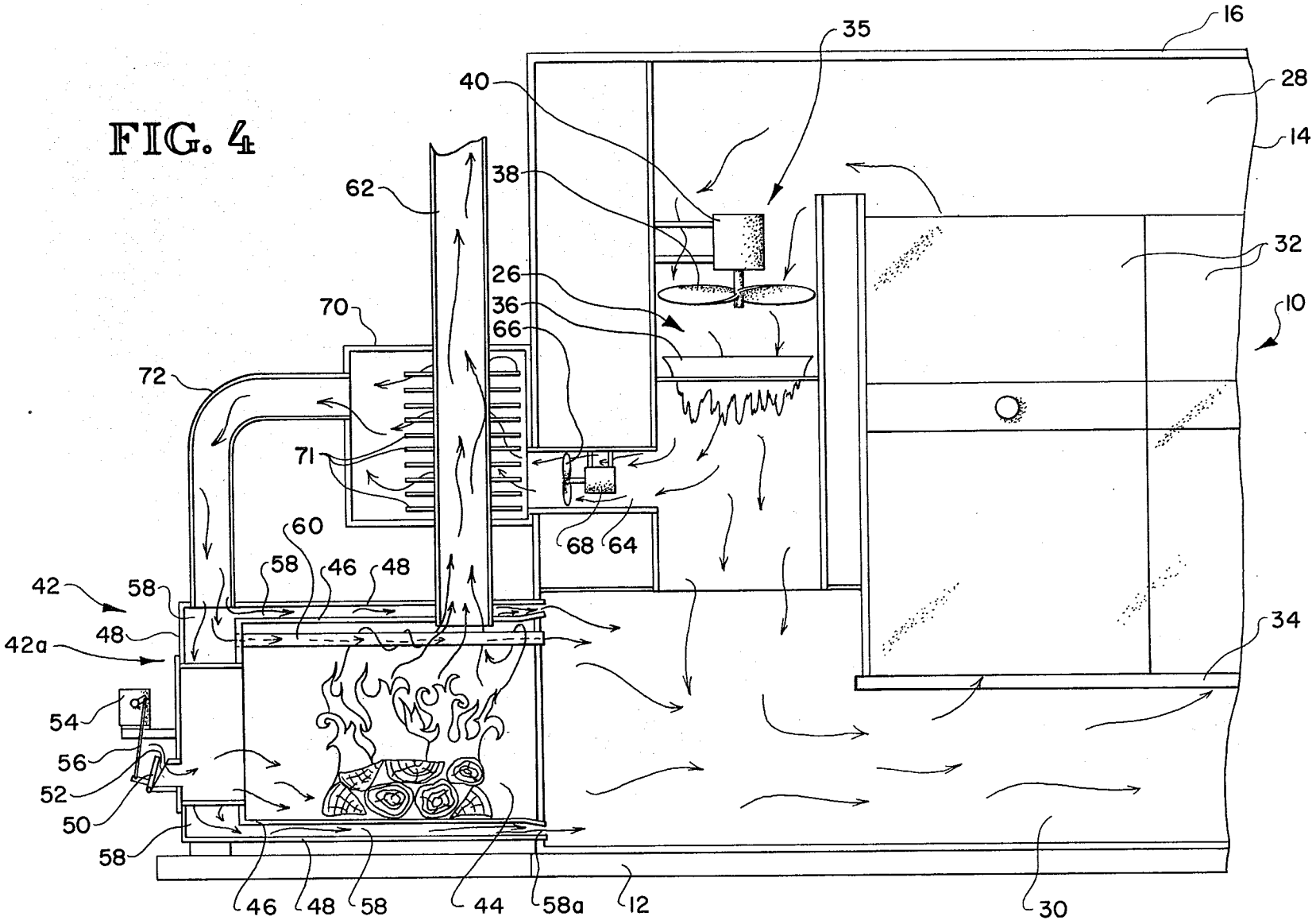
FIG. 4 is a fragmentary side elevational view of the bulk tobacco barn with the auxiliary heating system disposed about the rear being shown in section, and with a side wall of the actual barn structure being removed to show the internal area about the rear portion of the barn.

As illustrated in FIG. 4, it is seen that the rear extremities of the double wall construction 46 and 48 of the heater that lies adjacent the rear wall of the barn 10, is designed such that the two walls 46 and 48 generally converge, as illustrated by the numeral 58*a*. This acts as a restriction and as will be understood from subsequent portions of the disclosure tends to allow air to be generally uniformly dispersed about the fire box 44.

Continuing to refer to the auxiliary heating system 42, it is seen in FIG. 4 that a conduit system is provided between the rear of the barn 10 and the heater 42*a* for transferring air from the barn to the double wall opening area 58 about the heater. In this regard, a conduit 64 is provided just below the burner 36, and within the conduit 64 there is mounted a second fan 66 driven by a motor 68. When driven, fan 66 is effective to direct a portion of the system of air being generated and circulated by the conventional forced air heating system 35 therefrom and into a heat exchanger 70 that surrounds flue 62. A series of spaced apart fins 71 that are dispersed about flue 62 are intended to increase the efficiency of the heat exchanger 70 so as to recapture as much heat as possible that is associated with the flue gases being drafted up the flue 62. The fins 71 are optional, and other devices such as bottles may be used to increase efficiency. As air is moved from the interior of the barn 10, through conduit 64, through heat exchanger 70, there is provided a pair of conduits or pipes 72 and 74 communicatively connected with the heat exchanger 70 for directing air therefrom to the heater 42*a*. Pipes 72 and 74 are communicatively connected to the outer open wall structure, that is the area between walls 46 and 48, such that air being directed through the pipes 72 and 74 by fan 68 is caused to be dispersed generally uniformly through the open area 58 lying between walls 46 and 48 and to generally collect the heat being given off by the wood, coal or other material being burned within the fire box 44. It is appreciated that since the inlet ends of pipes 60 are communicatively connected to the open area 58 that the air is also dispersed through the pipes which are actually exposed within the fire box 44. Therefore, it is appreciated that the portion of air pulled from the system of air being circulated through the barn 10 is directed through the heat exchanger 70, through pipes 72 and 74, and through the confined heat exchange areas associated with the heater 42*a* of auxiliary heating system 42, and on into the lower plenum of the barn 10. It is appreciated that although a fan 66 is utilized to pull a portion of the air from the system of air being circulated, that other suitable means may be employed such as an air scoop or the like.

In the operation of the bulk barn 10 of the present invention with the dual heating systems, the conventional forced air heating system 35 is the primary reliance system. The auxiliary heating system 42 is generally utilized as a first priority heating source and the temperature control means provided would be operatively connected to both the forced air circulating system 35 and the auxiliary heating system 42. Details of the temperature control are not illustrated herein because such is well known in the art, but it can be stated that since the auxiliary heating system 42 would be considered the first priority source of heat, then it follows that so long as there was heat being provided by the fire box 44 that the temperature control would look to the auxiliary heating system 42 to meet the temperature requirements of the curing and drying schedule being followed. As pointed out above, the temperature could actually be controlled by the modulation of damper 50. If the auxiliary heating system is without wood, coal or any other material to be burned, then the temperature control system would actuate the conventional forced air heating system 35 which would then be the principal and, in that case, the only heating source. In addition, if the auxiliary heating system is being used but yet the heat output thereof for any given reason is not sufficient to meet the temperature requirements called for by the curing and drying schedule, then the temperature control means would be over-ridden so as to cause the conventional forced air heating system to be actuated, and particularly the burner 36 in order to add sufficient heat to the system to reach the temperature being called for. It is appreciated that the fan 38 of the conventional forced air system 35 would be ran continuously in order to supply the air to the tobacco material within the containers 32. The burner 36 would only be actuated when there was a need for more heat and the auxiliary heating system 42 could not provide that additional heat, or was not in an operative mode for any given reason.

From the foregoing specification, it is appreciated that the present invention presents a bulk tobacco barn with a dual heating system comprising a first conventional forced air heating system, and a second auxiliary heating system. One particular advantage to the present invention is that the auxiliary heating system of the present invention is particularly adapted to utilize sources of fuel such as wood, coal or the like that may be readily available to the farmer. It should be pointed out that the fire box of the auxiliary heating system 42 would be constructed of heavy duty metal and any open fire therein would be isolated from the barn structure or the tobacco therein. Moreover, in case electricity would be interrupted to the barn 10, the temperature control means and particularly controller 54 would be designed such that the damper 50 would close in response to an interruption of electricity.

The terms "upper," "lower," "forward," "rearward," etc., have been used herein merely for the convenience of the foregoing specification and in the appended claims to describe the auxiliary heating system for a bulk tobacco barn and its parts as oriented in the drawings. It is to be understood, however, that these terms are in no way limiting to the invention since the auxiliary heating system for a bulk tobacco barn may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. In a bulk tobacco curing and drying structure having a generally enclosed drying area, means for supporting tobacco in bulk form in said drying area, and a forced air heating system including fan means for generating and circulating a system of air through the tobacco material supported within said drying area and thermostatically controlled heating means for heating the circulated air to effectuate curing and drying of the tobacco material within the structure, the improvement comprising an auxiliary heating system for supplying heat to said system of air to assist in the curing and drying of the tobacco within said drying area, said auxiliary heating system comprising: a heater having a fire box for receiving wood, coal and other burnable material; an outer wall structure surrounding a substantial portion of said heater so as to form an air passing area therebetween that defines and acts as a heat exchanger when air is moved therethrough; means for directing a portion of air from said system of air being circulated through said structure to said heater and through the heat exchanger disposed about said fire box and back to the system of circulating air moving through the curing and drying structure; and temperature control means operatively associated with said heater and responsive to the temperature within said curing and drying structure for controlling the heat output of said heater and the auxiliary heating system.

2. The improved curing and drying structure of claim 1 wherein said heater of said auxiliary heating system includes an opening to said fire box and a damper movably mounted adjacent said opening for controlling the flow of air therethrough, and wherein a flue is communicatively connected to said fire box such that when said damper is open air may be drafted through said opening, through the fire box and up the flue; and wherein said temperature control means for controlling the output of said heater comprises means for sensing the temperature within said curing and drying structure, and means responsive to the sensed temperature for opening and closing said damper in a modulating manner to control the heat output of said heater of the auxiliary heating system.

3. The improved curing and drying structure of claim 2 wherein said means for directing a portion of said system of air to said auxiliary heating system and to said heater thereof comprises an electrically driven fan disposed in proximity to the passing air of said system of air being moved through the curing and drying structure for inducing a portion of the air therefrom and through said electrically driven fan means toward said heater of the auxiliary heating system.

4. The improved curing and drying structure of claim 3 wherein said auxiliary heating system includes duct means communicatively connected between said electrically driven fan and said heater of said auxiliary heating system for transferring air induced by said electrically driven fan to said heater where the air moves within the space between the heater and said outer wall structure thereof to collect heat from said heater prior to being directed back into the curing and drying structure where the air joins with the system of circulating air.

5. The improved curing and drying structure of claim 4 wherein restriction means is operatively provided for within the area between said heater and said outer wall so as to cause air flowing past the heater to be generally uniformly dispersed over the area of the heater where the heat exchanger is defined by the presence of said outer wall.

6. The improved curing and drying structure of claim 5 wherein a second heat exchanger is provided about said flue for collecting heat from the flue gases being exhausted therethrough, and wherein said second heat exchanger is operatively connected between said electrically driven fan and said heater of said auxiliary heating system in said duct means that allows air to be directed from said system of air circulating within said curing and drying structure to said heater.

7. The improved curing and drying structure of claim 1 wherein said heater is provided with pipes that extend exposed through said fire box and which includes inlet ends that are communicatively connected with the open area between said heater and said outer wall such that air being directed to said heater can be uniformly dispersed through said plurality of pipes, and wherein said pipes include an exiting end communicatively connected to said curing and drying structure such that air passing therethrough can be directed back into said curing and drying structure where the same air joins the system of air being circulated therethrough.

8. The improved curing and drying structure of claim 7 wherein the curing and drying structure is of the conventional type having a furnace room disposed about the rear thereof that generally houses said forced air heating system of said curing and drying structure, and wherein said auxiliary heating system is disposed generally adjacent said furnace room of said curing and drying structure and wherein the heat exchange area defined between the heater and said outer wall is communicatively connected to a lower plenum area of the curing and drying structure defined below the level of said fan means and heating means enclosed within said furnace room.

9. The improved curing and drying structure of claim 8 wherein said temperature control means is operative to control both said auxiliary heating system and said forced air heating system, said temperature control means being functional to first cause the necessary heat from said auxiliary heating system to hold a certain temperature within said curing and drying structure, and further operative to actuate said forced air heating system to make up any additional heat needed to reach that certain temperature.

* * * * *